US009567132B2

(12) United States Patent
Lundius

(10) Patent No.: US 9,567,132 B2
(45) Date of Patent: Feb. 14, 2017

(54) COLLAPSIBLE SUPERSTRUCTURE

(71) Applicant: Crossborder Technologies AB, Trelleborg (SE)

(72) Inventor: Christer Lundius, Trelleborg (SE)

(73) Assignee: Crossborder Technologies AB, Trelleborg (SE)

( * ) Notice: Subject to any disclaimer, the term of this patent is extended or adjusted under 35 U.S.C. 154(b) by 0 days.

(21) Appl. No.: 14/379,275

(22) PCT Filed: Feb. 21, 2013

(86) PCT No.: PCT/SE2013/050151
§ 371 (c)(1),
(2) Date: Aug. 15, 2014

(87) PCT Pub. No.: WO2013/126011
PCT Pub. Date: Aug. 29, 2013

(65) Prior Publication Data

US 2015/0021229 A1 Jan. 22, 2015

(30) Foreign Application Priority Data

Feb. 22, 2012 (SE) ..... 1250156

(51) Int. Cl.

| | |
|---|---|
| ***A45C 11/04*** | (2006.01) |
| ***B65D 19/06*** | (2006.01) |
| ***B65D 19/00*** | (2006.01) |
| ***B65D 19/12*** | (2006.01) |

(52) U.S. Cl.
CPC ..... *B65D 19/06* (2013.01); *B65D 19/0095* (2013.01); *B65D 19/12* (2013.01);
(Continued)

(58) Field of Classification Search
CPC ..... B65D 19/06; B65D 19/12; B65D 2519/00164; B65D 2519/00199; B65D 2519/00233;B65D 2519/00422; B65D 2519/00497
See application file for complete search history.

(56) References Cited

U.S. PATENT DOCUMENTS 964,121 A * 7/1910 Rose ..... B65D 11/1833 220/646
2,596,881 A 5/1952 White
(Continued)

FOREIGN PATENT DOCUMENTS

| | | |
|---|---|---|
| FR | 2.087.661 | 12/1971 |
| FR | 2.102.885 | 4/1972 |
| WO | 2011/049494 A1 | 4/2011 |

OTHER PUBLICATIONS

International Search Report and Written Opinion mailed Jul. 1, 2013, issued in corresponding International Application No. PCT/SE2013/050151, filed Feb. 21, 2013, 11 pages.

*Primary Examiner* — Anthony Stashick
*Assistant Examiner* — James Way
(74) *Attorney, Agent, or Firm* — Christensen O'Connor Johnson Kindness PLLC

(57) ABSTRACT

In summary, this document describes a collapsible superstructure 1 for a pallet 15, wherein the superstructure 1 comprises: four corner profiles 10, a first pair of opposite sides 11 of the superstructure 1, a second pair of opposite sides 12*a*, 12*b* of the superstructure 1, wherein at least one of the sides in said first pair of opposite sides 11 or said second pair of opposite sides 12*a*, 12*b* is provided with an openable portion 16 in an opening. Moreover, the openable portion 16 is designed such that displacement, in a horizontal direction H along said side provided with an opening, of a first abutment portion relative to a second abutment portion, substantially diagonally opposite the first abutment portion, is counteracted, and such that displacement, in the horizontal direction H along said side provided with an
(Continued)

opening, of a third abutment portion relative to a fourth abutment portion, substantially diagonally opposite the third abutment portion, is counteracted, whereby a unidirectional angle setting of the two corner profiles 10, connected to the side provided with an opening, along said side provided with the opening, is counteracted.

16 Claims, 4 Drawing Sheets

(52) U.S. Cl.
CPC ..... *B65D 2519/00164* (2013.01); *B65D 2519/00199* (2013.01); *B65D 2519/00233* (2013.01); *B65D 2519/00422* (2013.01); *B65D 2519/00497* (2013.01); *B65D 2519/00502* (2013.01); *B65D 2519/00601* (2013.01); *B65D 2519/00606* (2013.01); *B65D 2519/00611* (2013.01); *B65D 2519/00661* (2013.01); *B65D 2519/00711* (2013.01); *B65D 2519/00875* (2013.01); *B65D 2519/00915* (2013.01); *B65D 2519/00975* (2013.01)

(56) References Cited

U.S. PATENT DOCUMENTS 2,756,894 A * 7/1956 Phillips ..... B65D 19/12 108/53.3
2,771,211 A 11/1956 Schrader, Sr.
2,775,360 A 12/1956 Phillips
2,803,084 A * 8/1957 Frerking ..... A01K 63/00 220/6
2,815,880 A 12/1957 Blatz
3,765,556 A * 10/1973 Baer ..... B65D 88/022 220/1.5
4,373,637 A * 2/1983 Shippell ..... B65D 19/06 206/600
4,630,746 A * 12/1986 Fortenberry ..... B65D 19/18 220/1.5
5,107,639 A * 4/1992 Morin ..... E04B 1/3445 220/6
5,323,921 A * 6/1994 Olsson ..... B65D 45/24 217/12 R
5,572,854 A * 11/1996 Greiner ..... B65D 19/12 53/390
5,601,202 A * 2/1997 Meacham ..... B65D 11/1833 220/1.5
6,299,011 B1 * 10/2001 Rosenfeldt ..... B65D 9/38 16/388
6,776,300 B2 * 8/2004 Walsh ..... B65D 19/18 206/386
7,703,632 B2 * 4/2010 Kochanowski ..... B65D 88/005 217/12 R
9,416,528 B2 * 8/2016 Schaffert ..... E04B 1/344
2003/0071038 A1 * 4/2003 Tanzer ..... B65D 19/06 220/4.29
2006/0260976 A1 * 11/2006 Apps ..... B65D 19/18 206/600

* cited by examiner

COLLAPSIBLE SUPERSTRUCTURE

TECHNICAL FIELD

The present invention relates to a collapsible superstructure for a pallet.

BACKGROUND OF THE INVENTION

Pallets are used to transport many different types of loads. A pallet may be used separately, purely as a load bearer, in order to facilitate the handling of loads in the form of one or more items. A pallet may also be used together with what is called a superstructure. The superstructure may be provided with walls, and, in this case, part of its function is that, when it is placed on top of the pallet, it delimits the loading space with its walls, which then extend around the load-bearing surface of the pallet. Awkward loads, such as small packages or loose objects, may then also be transported on the pallet. The superstructure may also be used to create an even surface on top of which a further pallet may be placed, so-called stacking. Known superstructures are usually made of wood, plastic or corrugated board.

In order to delimit the loading space at the top, a superstructure may also have a lid. This provides additional protection for the load.

One or more of the sides of the superstructure may be provided with windows to permit access to the load without having to remove the whole superstructure.

To be able to effectively transport and store pallets with their load, it is in many cases desirable to be able to stack one or more pallets onto pallets with superstructures. An upper pallet is then placed such that it is supported by the superstructure of a lower pallet. The weight of the upper pallet, and possibly of further pallets lying on top of it, is placed on the superstructure.

An example of a commonly used superstructure is a so-called pallet collar. Pallet collars often consist of a wooden frame which is provided with four hinge joints of metal in the four corners. The metal pieces that form the hinge joint are provided with downwardly and outwardly extending tongues which engage around the corners of the pallet or an underlying pallet collar. Several pallet collars stacked on top of one another provide a higher and therefore larger loading space.

A problem with pallet collars is that they are awkward to handle and difficult to store when not in use. A solution to these problems is to provide a more collapsible superstructure. There are known superstructures which are collapsible by virtue of the fact that they are provided with further hinge joints in addition to the four in the corners. These further hinge joints are placed, for example, on the two opposite short sides. In this way, the short sides may be collapsed inward and the superstructure may then be folded up such that its necessary area becomes slightly less than the surface area of the pallet. An advantage of this is that the superstructure, when collapsed, may then be placed on the pallet during transport of the pallet, after the load has been removed. However, collapsible superstructures of this known type are unable to cope with such a great load as may a pallet collar composed of a wooden frame and metal hinge joints. The reason is that the design of the collapsible superstructure with further hinge joints, and in some cases with an openable window, adversely affects the load-bearing capacity, which means that the superstructure is deformed under a lower load than is a pallet collar.

Consequently, there can be said to be a need for an improved superstructure that is easy to store and that has an improved load-bearing capacity, particularly in the event of stacking pallets with superstructures.

SUMMARY OF THE INVENTION

A general object of the present invention is therefore to provide an improved superstructure for placing on a pallet. A further object is to make available an ergonomic and easily stored superstructure with an improved load-bearing capacity, particularly in the event of stacking pallets with superstructures.

According to a first aspect, the present invention relates to a collapsible superstructure for a pallet, wherein the superstructure comprises four corner profiles (10) arranged to, in a raised position of the superstructure, be placed standing upright, in a vertical direction (V), at each corner of said pallet, a first pair of opposite sides of the superstructure, which sides are each provided with at least one inner hinge joint, standing upright in the vertical direction, and which sides are each connected to two corner profiles, a second pair, separate from said first pair, of opposite sides of the superstructure, which sides are each connected to two corner profiles, wherein, at each one of the corner profiles, at least one of the sides connected to the respective corner profile is connected via upright standing hinge joints for permitting collapse of the superstructure, wherein at least one of the sides in said first pair of opposite sides or said second pair of opposite sides is provided with an openable portion in an opening.

The collapsible superstructure is characterized in that the openable portion is designed such that displacement, in a horizontal direction along said side provided with an opening, of a first abutment portion relative to a second abutment portion, substantially diagonally opposite the first abutment portion, is counteracted, and such that displacement, in the horizontal direction along said side provided with an opening, of a third abutment portion relative to a fourth abutment portion, substantially diagonally opposite the third abutment portion, is counteracted, wherein the first abutment portion and the third abutment portion are arranged to abut directly or indirectly on one of the corner profiles connected to the side provided with an opening, and wherein the second abutment portion and the fourth abutment portion are arranged to abut directly or indirectly on the other of the corner profiles connected to the side provided with an opening, whereby a unidirectional angle setting of the two corner profiles, connected to the side provided with an opening, along said side provided with the opening, is counteracted.

According to one embodiment, the superstructure is designed as follows: the first pair of opposite sides and the second pair of opposite sides constitute four walls in the rectangular superstructure. The corner profiles constitute the corners of the rectangular shape. By means of the inner hinge joints of each of the sides in the first pair of opposite sides and the hinge joints at each corner profile (which connect at least one of the sides connected to the respective corner profile), the collapsibility of the superstructure is achieved. The inner hinge joint is arranged upright standing in the vertical direction. The inner hinge joint advantageously extends in the vertical direction along the entire side. The hinge joint may be divided in the vertical direction into several portions in order to allow a side provided with inner hinge joint to be provided with an openable window. The inner hinge joint connects two portions of the side where the two portions are arranged side by side on both sides of the inner hinge joint.

Each one of the sides in the first pair of opposite sides is preferably connected to two corner profiles via upright standing outer hinge joints in order to permit collapse of the superstructure. The outer hinge joints are then arranged to connect the respective side in the first pair of opposite sides to each of the corner profiles on each side of the respective side.

The inner hinge joints and the hinge joints at each corner profile allow the first pair of opposite sides to be folded in. Upon folding in, the portions of the side are folded in toward the center of the superstructure, at the same time as the corner profiles on each side of the respective side in the first pair of sides are driven substantially toward each other. In this way, a folded-up superstructure is obtained which is easy to store, is light and ergonomic to handle and may be stored in a manner that saves space.

The openable portion in at least one of the sides in the first pair of opposite sides or the second pair of opposite sides permits access to the load without the need to remove the entire superstructure. The openable portion is openable by means of a hinge joint. The hinge joint is preferably arranged along what is, in the vertical direction, a lower edge of the openable portion. The openable portion may constitute part or all of the extent of the side in question between the corner profiles to which the side is connected.

Preferably, at least one of the sides in at least said second pair of opposite sides is provided with said openable portion in an opening.

When the superstructure is subjected to loading, such as overloading on the superstructure or horizontally directed forces, the corner profiles constitute weak points. In the event of excessive loading, the corner profiles bend, as a result of which the superstructure is deformed. In order to prevent the corner profiles from bending in the horizontal direction along the side provided with an opening, the openable portion is arranged such that displacement in the horizontal direction along the openable side is counteracted for a first abutment portion relative to a second abutment position substantially diagonally opposite the first abutment portion, and for a third abutment portion relative to a fourth abutment portion substantially diagonally opposite the third abutment portion. In addition, the first abutment portion and the third abutment portion are arranged to abut directly or indirectly on one of the corner profiles connected to the side provided with an opening, and the second abutment portion and the fourth abutment portion are arranged to abut directly or indirectly on the other of the corner profiles connected to the side provided with an opening. By counteracting mutual displacement of the abutment portions of the openable portion in correct combination and allowing the respective abutment portion to abut (directly or indirectly) on the same or opposite corner profile in correct combination, it is also possible to ensure that the corner profiles which are connected to the side provided with an opening do not bend in the same sense in the horizontal direction along the side provided with an opening. An example of a scenario where there is a need of such counteracting of bending of the corner profiles is when the superstructure arranged on a pallet is transported in a vehicle. The superstructure is then exposed to forces of acceleration and deceleration which work to shape the pair of corner profiles, which are connected to the side provided with an opening, into a unidirectional angle setting—that is to say into a parallelogram. Since these forces are counteracted by the shape of the opening portion according to the present invention, deformation of the superstructure is thereby counteracted.

A reinforcement of the superstructure in accordance with the invention is advantageous by comparison with other more immediately available alternatives. An immediately available solution in an excessively weak construction is to reinforce the sides and/or the corner profiles by using a thicker material. However, this solution would mean higher costs for material and a heavier construction. None of these consequences is desirable.

Preferred embodiments are set forth in the dependent claims.

Preferably, the superstructure further comprises a holding member which connects the four corner profiles such that as to counteract an outward angle setting of one or more of the corner profiles from their desired upright standing position. A non-limiting example of a holding member of this kind is a horizontally extending tightening strap which is arranged on the outside, about the perimeter whose corners are formed by the four corner profiles. Another non-limiting example is a lid which is arranged in the vertical direction on top of the superstructure and which has a vertically extending edge which extends around and outside the corner profiles and preferably about the entire perimeter of the superstructure. The holding member is arranged such that that a displacement of each corner profile in the direction outward from the superstructure is counteracted.

The holding member is preferably removable from the superstructure. This facilitates access to the load on the pallet. In addition, it is advantageous that the holding member may be removed from the superstructure upon collapse of the superstructure.

Moreover, the holding member is preferably arranged to counteract an inward angle setting of one or more of the corner profiles from their desired upright standing position toward the loading space of the superstructure. A non-limiting example of such an embodiment is one in which the holding member comprises a lid according to the above, which lid comprises an internal inner portion which is recessed in relation to an outer edge portion of the lid. Preferably, the distance between the corner profiles which are arranged on each side of the first pair of sides is shorter than the distance between the corner profiles which are arranged on each side of the second pair of sides. In this way, the superstructure may be configured such that, when the superstructure is folded up, the first pair of sides are folded in a direction toward each other but do not come into contact with each other at the center of the superstructure.

At least one of the corner profiles and sides is preferably produced from metal, preferably of sheet metal. The sides are preferably produced from a plate with a thickness in the range of 0.4-1 millimeter. The corner profiles are preferably produced from a plate with a thickness in the range of 0.6-2 millimeters, preferably 0.6-1.5 millimeters. Alternatively, the corner profiles are produced by extrusion.

Preferably, the openable portion has a first stiffening portion and a second stiffening portion which are each arranged to extend along said side provided with an opening, substantially in the horizontal direction, and which are located at a distance from each other in the vertical direction, wherein the first stiffening portion comprises the first abutment portion and the fourth abutment portion, and wherein the second stiffening portion comprises the second abutment portion and the third abutment portion.

It is also advantageous that the first stiffening portion and the second stiffening portion are connected to each other such that displacement of the first stiffening portion relative to the second stiffening portion in the horizontal direction along said side provided with an opening is counteracted.

The openable portion may advantageously be provided with a first side-edge portion, which connects the first abutment portion to the third abutment portion, and may be provided with a second side-edge portion, which connects the second abutment portion to the fourth abutment portion.

The openable portion is preferably formed by one or more plates which are provided with stiffening folds that extend substantially in the horizontal direction along said side provided with an opening. This provides further stiffening with respect to forces oriented in the horizontal direction along the openable portion. The stiffening folds ensure that the openable portion does not bend in the direction perpendicular to the extent of the openable portion. It is also advantageous that the stiffening folds in the horizontal direction extend across substantially the whole of the openable portion.

The openable portion may be provided with a central opening. This may be used to permit observation of the loading space in the superstructure even when the openable portion is folded up. In addition or as an alternative, this may be used to reduce the weight of the openable portion.

In order to protect the load, the central opening may be covered completely or partially by a covering member. For example, it is possible to use thinner plate, plastic sheets, nets or woven fabrics in order to obtain a lighter construction. To permit observation of the loading space, the covering member may be completely or partially transparent. Non-limiting examples of such a covering member are surfaces, for example of plastic or metal, which have been provided with a number of through-holes, nets or woven fabrics which are at least partially transparent and which have been produced, for example, from wire netting, textile, plastic or similar fiber net.

The superstructure may be produced completely or partially from a material other than plate. Examples of such materials are hard plastics and extruded aluminum.

In an alternative embodiment, the openable portion, with or without central opening, is produced from extruded aluminum. An advantage of extruded aluminum is that screws may be used for fastening purposes, instead of welding. This may permit easier assembly and manufacture of the superstructure.

For an improved load transfer, between the corner profiles and the side provided with an opening, of forces oriented in the horizontal direction along the side provided with an opening, the corner profiles connected to the side provided with an opening may each comprise an abutment surface which at least partially extends in the vertical direction and which at least partially extends in a transverse direction which is perpendicular to the side provided with an opening, wherein the respective abutment portions of the openable portion are arranged to abut on the respective abutment surface of the corner profiles and are arranged to transfer pressure forces. The pressure forces are the forces with which a respective corner profile acts on the side provided with an opening.

The abutment surfaces of each of the corner profiles advantageously have a normal direction which is oriented toward the openable portion, i.e. the abutment surface extends completely in the transverse direction which is perpendicular to the side provided with an opening.

For an improved load transfer, between a non-openable portion and the openable portion, of forces oriented in the horizontal direction along the side provided with an opening, the non-openable portion of the side provided with an opening may comprise, on both sides of the openable portion, an abutment surface which at least partially extends in the vertical direction and which at least partially extends in a transverse direction which is perpendicular to the side provided with an opening, wherein the respective abutment portions of the openable portion are arranged to abut on the respective abutment surface of the non-openable portion and are arranged to transfer pressure forces.

The abutment surfaces of the non-openable portion advantageously have a normal direction which is oriented toward the openable portion, i.e. the abutment surface extends completely in the transverse direction which is perpendicular to the side provided with an opening.

Moreover, the superstructure advantageously comprises one or more locking members. Each locking member is arranged to lock one of the openable portions in a raised position such that it cannot be lowered. The locking member may be a free-standing member or may be connected to the superstructure.

BRIEF DESCRIPTION OF THE DRAWINGS

The invention will be described in more detail below with reference to the accompanying schematic drawings which, for illustrative purposes, show presently preferred embodiments of the invention.

DESCRIPTION OF PREFERRED EMBODIMENTS OF THE INVENTION

Figure 1A:
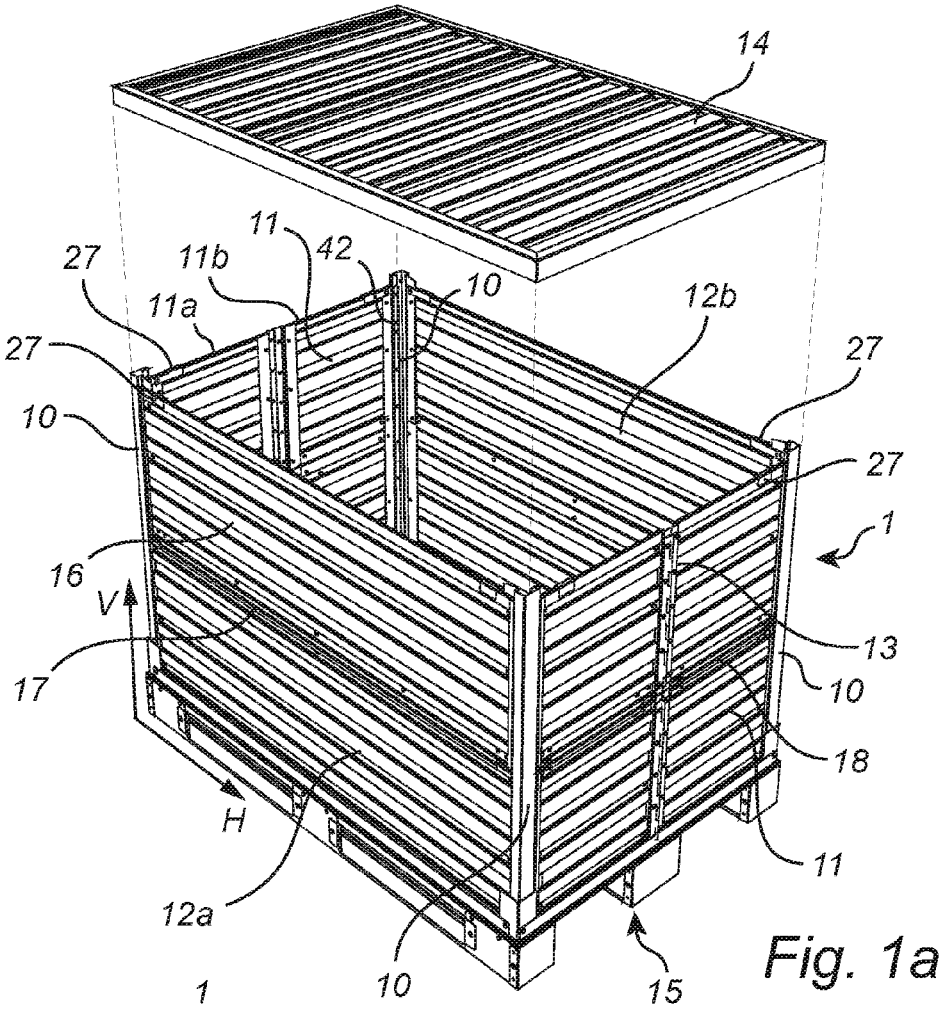
FIG. 1*a* illustrates a superstructure in a raised position, arranged on a pallet.

A raised superstructure 1 which is arranged on a pallet 15 is illustrated in FIG. 1*a*. The superstructure 1 comprises four corner profiles 10 which form the corners of a substantially rectangular box profile. The corner profiles 10 are placed upright standing in a vertical direction V. The sides of the box profile are formed by two pairs of sides: a first pair of opposite sides 11 and a second pair of opposite sides 12*a*, 12*b*. The sides 11 in the first pair of sides are provided with an inner hinge joint 13 and a pair of outer hinge joints 42. The inner hinge joint 13 is arranged substantially at the center of the respective side 11, that is to say substantially half way between the corner profiles 10 which adjoin the respective side 11. The inner hinge joint 13 in this embodiment consists of hinge irons. This applies also to the outer hinge joints 42. The hinge joints 13 are arranged in the vertical direction V along the entire vertical extent of the side 11.

The position, design and function of the outer hinge joints will be described in more detail in connection with FIG. 4*a*.

Figure 1B:
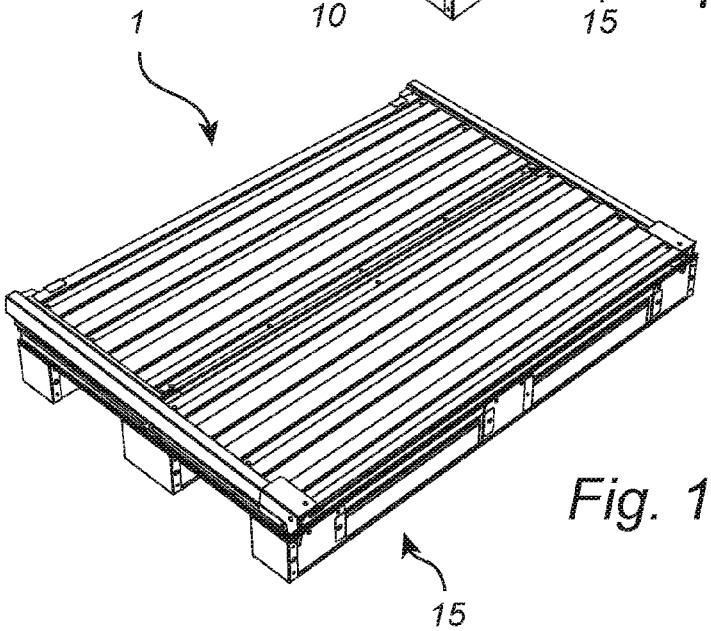
FIG. 1*b* illustrates the superstructure from FIG. 1*a* in a collapsed position and arranged on the pallet.

The inner hinge joint 13 and the outer hinge joints are arranged such that inward folding of the respective side 11 is permitted. The portions 11*a*, 11*b* of the side 11, which are located on each side of the hinge joint 13, are folded in toward the center of the superstructure 1, i.e. toward the loading space delimited by the superstructure. The superstructure 1 may then be collapsed into a flat format in which the folded-together sides 11 are located between the sides 12*a*, 12*b* of the second pair of opposite sides. The superstructure 1 in a collapsed state is illustrated in FIG. 1*b*.

FIG. 1*a* also illustrates the sides 12*a*, 12*b* in the second pair of opposite sides. The sides 12*a*, 12*b* are separate from the sides 11 in the first pair of opposite sides.

The side 12*a* is provided with an opening by means of the arrangement of an openable portion 16. The openable portion is connected to a non-openable portion of the side 12*a* by means of a hinge joint 17. In this way, the openable portion 16 may be folded down. This permits access to the loading space, which is delimited by the superstructure 1, without the need to remove the whole superstructure 1.

The hinge joint 17 may alternatively be arranged on another side edge than the lower side edge, in the vertical direction V, of the openable portion 16.

The sides 10, 12*a*, 12*b* of the superstructure 1 are produced from a plate material which has a thickness in the range of 0.4-1 millimeter. The corner profiles 10 are produced from a plate material which has a thickness in the range of 0.6-2 millimeters, preferably 0.6-1.5 millimeters.

It is advantageous that the superstructure 1 consists to a large extent of a non-combustible material, since this increases the safety of the superstructure 1.

The superstructure 1 further comprises a lid 14 which constitutes a holding member. The lid 14 holds the corner profiles 10 together such that, during loading, they do not bend outward from the superstructure 1.

The holding member may alternatively consist of other members that perform the same function, such as a clamping belt. The holding member does not have to be a free-standing part, and instead it may consist of an integrated portion in the design of the superstructure. An example of such a portion will be described in connection with the description of locking members below.

The holding member may also be configured to ensure that the corner profiles 10 do not bend in toward the loading space of the superstructure 1. For example, a holding member such as the lid 14 may have an internal inner portion which is lowered in relation to an outer edge portion. The lower inner portion abuts on the corner profiles 10 and may counteract a force that works to drive the corner profiles 10 inward.

The holding member is removable from the superstructure 1. In a collapsed state of the superstructure 1, the holding member may be placed on top of the superstructure 1, i.e. on top of the superstructure in FIG. 1*b*. In this way, the superstructure 1 and the holding member may be stored in a space-saving manner and handled with ease.

In a preferred embodiment, all the sides 11, 12*a*, 12*b* of the superstructure 1 are provided with an opening. An openable portion of each side 11 in the first pair of opposite sides may be arranged by means of a hinge joint 18 which is arranged between the openable portion and a non-openable portion in the side 11. The inner hinge joint 13 is then formed in at least two parts: a lower part of the non-openable portion and an upper part in the openable portion. These two parts of the inner hinge joint 13 may be folded along the hinge joint 18 between the openable and the non-openable portion of the side 11.

Figure 2A:
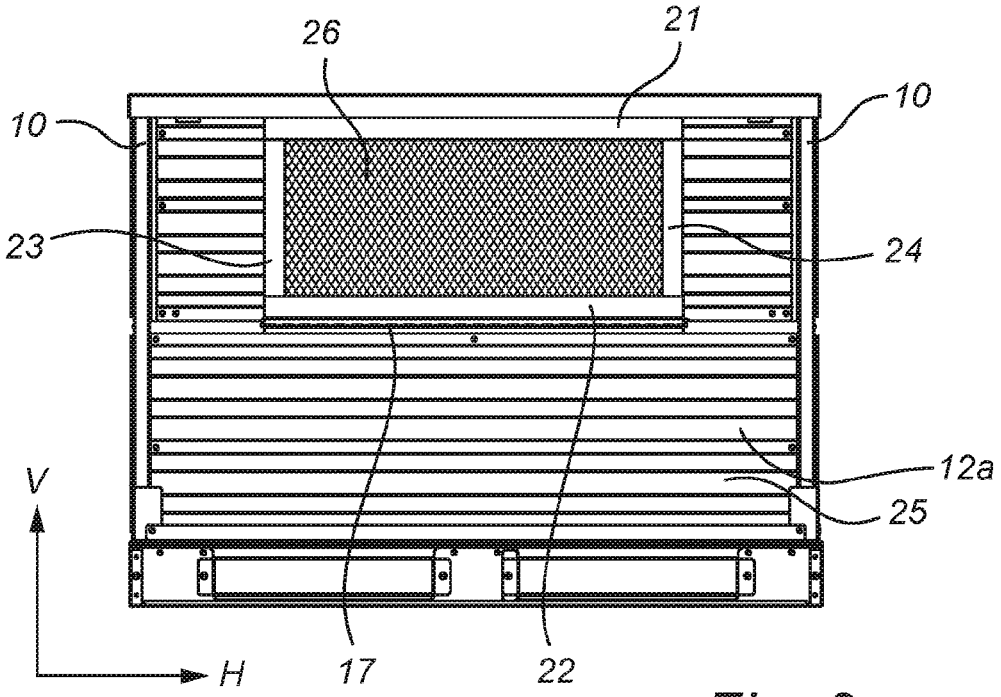
FIG. 2*a* and FIG. 2*b* are side views of different embodiments of one of the sides of the superstructure.

FIG. 2*a* illustrates an embodiment of the side 12*a* provided with an opening in FIG. 1*a*. The side 12*a* is arranged between and connected to the two corner profiles 10. In addition to the openable portion 16, the side 12*a* comprises a non-openable portion 25. The openable portion 16 is connected to the non-openable portion 25 by means of a hinge joint 17. It will be appreciated that the hinge joint 17 may alternatively consist of several hinge joints.

The design of the side 12*a* is adapted to counteract a unidirectional angle setting of the two corner profiles 10 along the side 12*a*. By unidirectional angle setting is meant that the corner profiles 10 are set at an angle in the same orientation, whereby the shape of the periphery of the side 12*a* can be likened to a parallelogram. An example of a scenario where forces cause a unidirectional angle setting is when the superstructure with pallet is placed in a truck for transport. During transport, the truck accelerates and decelerates, wherein the forces of acceleration and the forces of deceleration are transferred to the superstructure and act on the corner profiles 10. Similar forces arise when the pallet 15 together with the superstructure 1 is handled in a pallet truck or similar pallet-handling machine.

Figure 3:
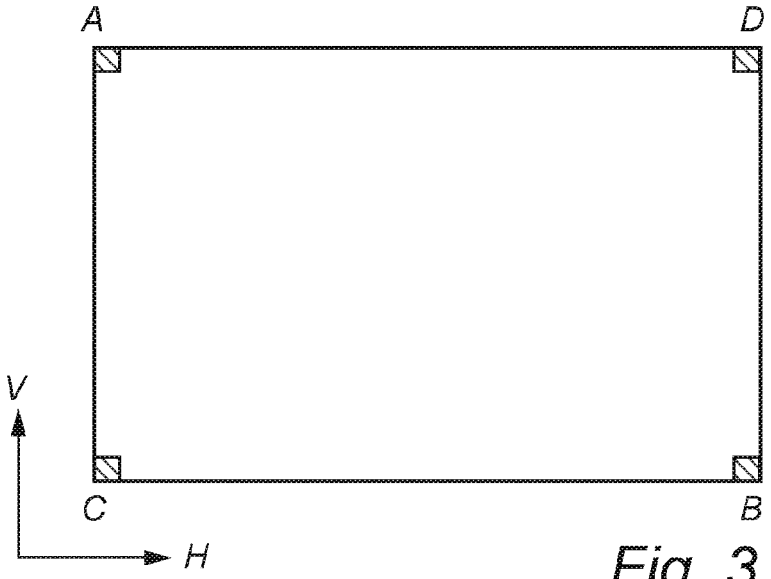
FIG. 3 is a view of the basic construction of an openable portion of one of the sides of the superstructure.

The basic design of the openable portion 16 for counteracting the abovementioned unidirectional angle setting of the corner profiles 10 will now be described on the basis of FIG. 3. The openable portion 16 is arranged in the same way as in FIG. 2*a*, that is to say along the horizontal direction H of the side 12*a* provided with an opening and along the vertical direction V.

Figure 2B:
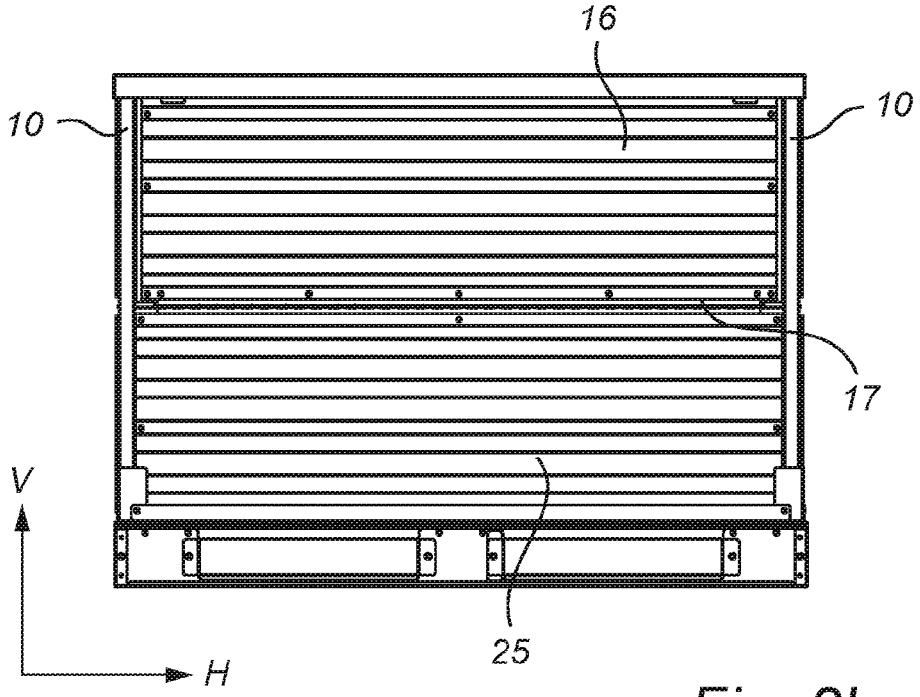

The openable portion 16 comprises a first abutment portion A, a second abutment portion B, a third abutment portion C and a fourth abutment portion D. The abutment portions A and B are diagonally opposite each other; and the abutment portions C and D are diagonally opposite each other. The openable portion 16 is designed such that a displacement of the first abutment portion A relative to the second abutment portion B is counteracted, and also such that a displacement of the third abutment portion C relative to the fourth abutment portion D is counteracted. This counteracting function may be achieved by means of a number of different types of designs of the openable portion 16. Two preferred embodiments are illustrated in FIGS. 2*a* and 2*b* and will be described in more detail below. Another example of an embodiment is to place cross-laid crossbeams: one crossbeam between the first abutment portion A and the second abutment portion B, and one crossbeam between the third abutment portion C and the fourth abutment portion D.

By virtue of the fact that the displacement of the abutment portions A, B, C, D in the openable portion 16 is counteracted, a corresponding displacement of the corner profiles 10 is also counteracted. In this way, the whole construction of the side 12*a* together with the corner profiles 10 is stiffened. The degree of the counteraction achieved by means of the design of the openable portion 16 also depends on a number of factors that will be appreciated by a person skilled in the art. For example, the way in which the side 12*a* is connected to the corner profiles 10 plays a part, and also how the openable portion 16 and how the non-openable portion 25 are designed. Different configurations may provide different degrees of counteraction. However, each gives an improved load resistance of the superstructure compared to corresponding known superstructures.

Each abutment portion A, B, C, D is located substantially at a respective corner of the openable portion 16 of the side 12*a* provided with an opening. The abutment portions A, B, C, D abut either on the non-openable portion 25 of the side provided with an opening or on one of the corner profiles 10 to which the side 12*a* provided with an opening is connected.

Returning to FIG. 2*a*, this illustrates a preferred design of the openable portion 16. A first stiffening portion 21 and a second stiffening portion 22 constitute a part of the openable portion 16. The first stiffening portion 21 and the second stiffening portion 22 extend in the horizontal direction H along the side 12*a* and are located at a distance from each other in the vertical direction V. The first stiffening portion 21 comprises the first abutment portion A and the fourth abutment portion D. The second stiffening portion 22 comprises the second abutment portion B and the third abutment portion C.

Moreover, the openable portion 16 comprises a first side-edge portion 23 and a second side-edge portion 24. The first side-edge portion 23 connects the first abutment portion A to the third abutment portion C. The second side-edge portion 24 connects the second abutment portion B to the fourth abutment portion D. The stiffening portions 21, 22 are thus connected to each other such that displacement of the first stiffening portion 21 relative to the second stiffening portion 22 in the horizontal direction H along the side 12*a* provided with an opening is counteracted. A unidirectional angle setting of the corner profiles 10 is thus also counteracted.

In this embodiment, the openable portion 16 abuts indirectly on each of the two corner profiles 10. This type of abutment will be explained in more detail in connection with FIG. 5.

The openable portion 16 is provided with a central opening 26. The latter is delimited by the first stiffening portion 21, the second stiffening portion 22, the first side-edge portion 23 and the second side-edge portion 24. The opening 26 permits observation of the loading space without opening the lid. The opening 26 also permits ventilation of the loading space, which is advantageous for certain types of load.

The central opening 26 is provided with a steel net. This permits observation and ventilation, while at the same time the load is protected and retained in the loading space. A certain degree of stiffening of the openable portion 16 may also be obtained by choosing a relatively stiff steel net.

It will be appreciated that the principle and the design of the openable portion 16 may be applied mutatis mutandis to an openable portion which is arranged in one of the sides 11 in the first pair of opposite sides.

FIG. 2*b* illustrates another preferred embodiment of the side 12*a* provided with an opening. The openable portion 16 extends across the entire side 12*a* in the horizontal direction H along the side 12*a*. The hinge joint 17 connects the openable portion 16 to the non-openable portion 25 situated below it in the vertical direction V. As in previous embodiments, the non-openable portion 25 of the side 12*a* is connected to the two corner profiles 10.

In this embodiment, the openable portion 16 abuts directly on each of the two corner profiles 10. This type of abutment will be explained in more detail in connection with FIGS. 4*a* and 4*b*.

Figure 6:
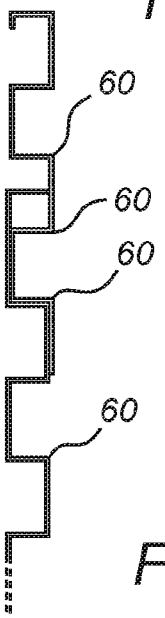
FIG. 6 illustrates a cross section of one of the sides provided with openings in the superstructure.

The openable portion 16 consists of a number of plates. The design of the latter will now be described in more detail with reference to FIG. 6. FIG. 6 illustrates a cross section through the plates which constitute the openable portion 16. The cross section is taken along the vertical direction V in FIG. 2*b*.

The plates are provided with stiffening folds 60 which extend in the horizontal direction H along the openable portion 16 and therefore along the side 12*a* provided with an opening. A plurality of plates are joined together to form substantially one piece by means of partial overlapping of the plates, as is illustrated in FIG. 6. The stiffening folds 60 provide improved stiffening with respect to forces in the horizontal direction H along the openable portion 16 compared to a plate with the same thickness but without stiffening profiles. Moreover, the stiffening folds 60 provide greater stiffening with less material consumption than would be the case with corresponding stiffening obtained by means of an increased thickness of the plates. A reduced material consumption also reduces the weight of the superstructure, which is also advantageous.

In FIG. 2*b*, the uppermost edge of the openable portion 16 in the vertical direction V is provided with an inward turn of the plate. This is also illustrated in FIG. 6. The inward turn provides further stiffening and also protects the surroundings, such as a user who is handling the superstructure, a lid lying on top and a surrounding load, from the sharp edges of the plate.

The stiffening folds 60 extend across the entire openable portion 16. This creates good stiffening. The stiffening folds 60 may alternatively extend over a part of the openable portion 16. Moreover, the non-openable portion 25 may be provided with corresponding stiffening folds.

Moreover, the openable portion 16 and/or the non-openable portion 25 in FIG. 2*a* may be provided with stiffening folds.

The superstructure 1 may further comprise one or more locking members 27. In such an embodiment, each locking member is designed to lock one of the openable portions 16 in a raised position such that lowering of the openable portion 16 is counteracted. The locking member may be a free-standing member or may be connected to the superstructure 1.

A non-limiting example of a locking member 27 is a substantially U-shaped locking member with a bottom and with two side surfaces which extend on each side and run in a direction perpendicular to the bottom. The locking member is arranged such that the bottom extends over the upper edge, in the vertical direction V, formed between the openable portion 16 and the non-openable portion 25 or corner profile 10. The side surfaces of the locking member extend in a direction counter to the vertical direction V and along the openable portion 16 and the non-openable portion 25 or the corner profile 10. This counteracts a movement of the openable portion 16 both in toward and also away from the loading space of the superstructure 1.

Alternatively, the sides of the locking member extend only downward on both sides of the upper edge of the openable portion 16, and the locking member is thus secured on the corner profile 10 or the non-openable portion 25 such that it may be lifted or turned upward from the openable portion 16, but such that it may counteract the openable portion 16 being opened in toward or away from the loading space of the superstructure 1.

Alternatively, the openable side may be arranged with a groove or recess in what is the upper edge in the vertical direction. The groove/recess is adapted such that a portion of the locking member may be arranged in the groove when the locking member is in a lowered position. Thereby, the corner profile 10 and the openable portion are connected (directly or indirectly) such that a movement of the corner profile 10 outward from the superstructure and in the horizontal direction H is counteracted. The locking member is preferably secured on the corner profile 10 or the non-openable portion 25 such that it may be lifted or turned upward from the openable portion 16 to a raised position.

The locking member designed in this way thus functions as a holding member and may be used as an alternative or complement to the previously mentioned examples of holding members.

The locking member may also be designed in accordance with a combination of the above embodiments for locking members. FIG. 4*a* illustrates the connection between the openable portion 16 and one of the corner profiles 10 in FIG. 2*b*. FIG. 4*a* is a view from above. The corner profile 10 comprises an abutment surface 40 which extends in the vertical direction V and in a transverse direction T which is perpendicular to the openable portion 16, that is to say which is perpendicular to the side 12*a* provided with an opening. The first abutment portion A and the third abutment portion C of the openable portion 16 are designed to abut substantially on the abutment surface 40 and are arranged to transfer a pressure force F from the abutment surface 40 to the first abutment portion A. The pressure force F is oriented in the horizontal direction along the side 12*a* provided with an opening.

Although there is a small gap between the abutment surfaces in the unloaded state of the superstructure, they directly come into contact with each other when subjected to loading. In this way, the corner profile 10 is not allowed too great an angle setting in the direction toward the openable portion 16 and instead abuts on the openable portion 16 such that the pressure force F may be transferred.

Figure 4A:
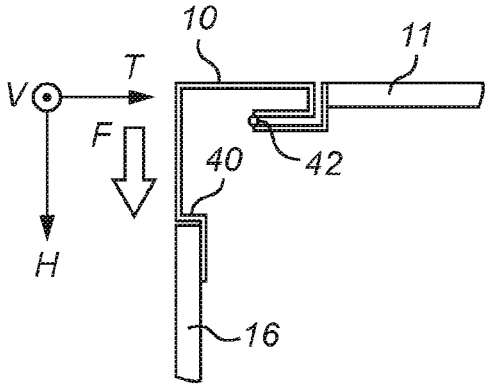
FIG. 4*a* and FIG. 4*b* are top views showing different embodiments of the connection between a corner profile and sides of the superstructure.

FIG. 4*a* also illustrates the connection between the corner profile 10 and the side 11 in the first pair of opposite sides of the superstructure 1. The previously described outer hinge joint 42 is illustrated here. The folding-in of the side 11 is achieved by means of the outer hinge joint 42 (together with the previously described inner hinge joint 13 and a further outer hinge joint). Other types of hinge joints 42 which satisfy the same basic function, that is to say which permit collapse of the superstructure 1, lie within the scope of the present invention.

Figure 4B:
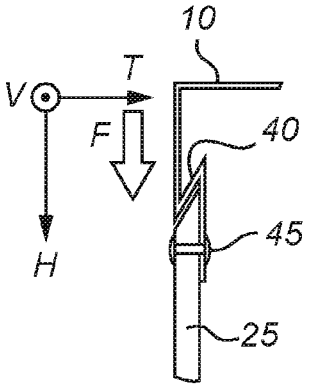

FIG. 4*b* illustrates a connection between the non-openable portion 25 and the corner profile 10 in FIG. 2*a* or FIG. 2*b*. In this embodiment, the abutment surface 40 extends in the vertical direction V and partially in the transverse direction T and partially in the horizontal direction H along the side 12*a* provided with an opening which comprises the openable portion 16. Since the abutment surface 40 is inclined according to FIG. 4*b*, this counteracts forces which tend to cause a displacement of the non-openable portion in a direction counter to the transverse direction T outward from the superstructure 1.

The non-openable portion 25 is connected to the corner profile 10 by means of a rivet 45 which runs in the transverse direction T through the non-openable portion 25 and the corner profile 10.

The basic design in FIG. 4*a* may likewise be applied to the connection between the non-openable portion 25 and the corner profile 10. Correspondingly, the basic design in FIG. 4*b* may be applied to the connection between the openable portion 16 and the corner profile 10. However, the openable portion 16 is not connected to the corner profile 10 by means of the rivet 45.

In the embodiment in FIG. 2*b*, the non-openable portion 25 is connected to the corner profile 10 with abutment surfaces according to the design in FIG. 4*a* but including one or more rivets according to FIG. 4*b*; and the openable portion 16 is connected to the corner profile 10 according to the basic design in FIG. 4*a*, but where the openable portion 16 is not connected to the corner profile 10 with any rivet.

Figure 5:
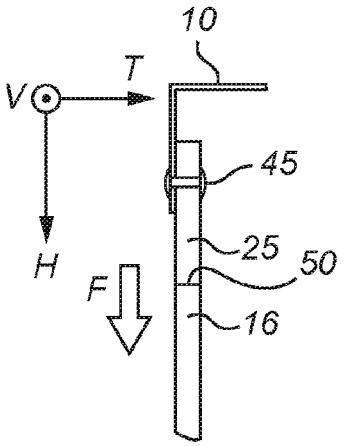
FIG. 5 is a top view showing an alternative embodiment to the embodiments illustrated in FIG. 4*a* and FIG. 4*b*.

FIG. 5 is also a top view and illustrates an alternative connection between the openable portion 16, the non-openable portion 25 and one of the corner profiles 10 for the embodiment which is illustrated in FIG. 2*a*. The non-openable portion 25 is connected to the corner profile 10 by means of rivets 45 along the full extent of the corner profile 10 in the vertical direction V. The non-openable portion 25 comprises an abutment surface 50 which extends in the vertical direction and which extends in the transverse direction T. The transverse direction T is perpendicular to the side 12*a* provided with an opening. The first abutment portion A and third abutment portion C of the openable portion 16 are arranged to transfer a pressure force F from the abutment surface 50 to the first abutment portion A and the third abutment portion C. The pressure force F is oriented in the horizontal direction along the side 12*a* provided with an opening.

FIGS. 4*a*-4*b* and 5 illustrate the connection between one of the two corner profiles 10, to which the side 12*a* is connected, and the openable portion 16 or the non-openable portion 25. This design is also provided for the corresponding connection between the other of the two corner profiles 10, to which the side 12*a* is connected, and the same openable portion 16 and non-openable portion 25. In the corresponding case for FIG. 5, it is the second abutment portion B and the fourth abutment portion D that are arranged to abut on an abutment surface 50 of the non-openable portion 25.

Figure 7:
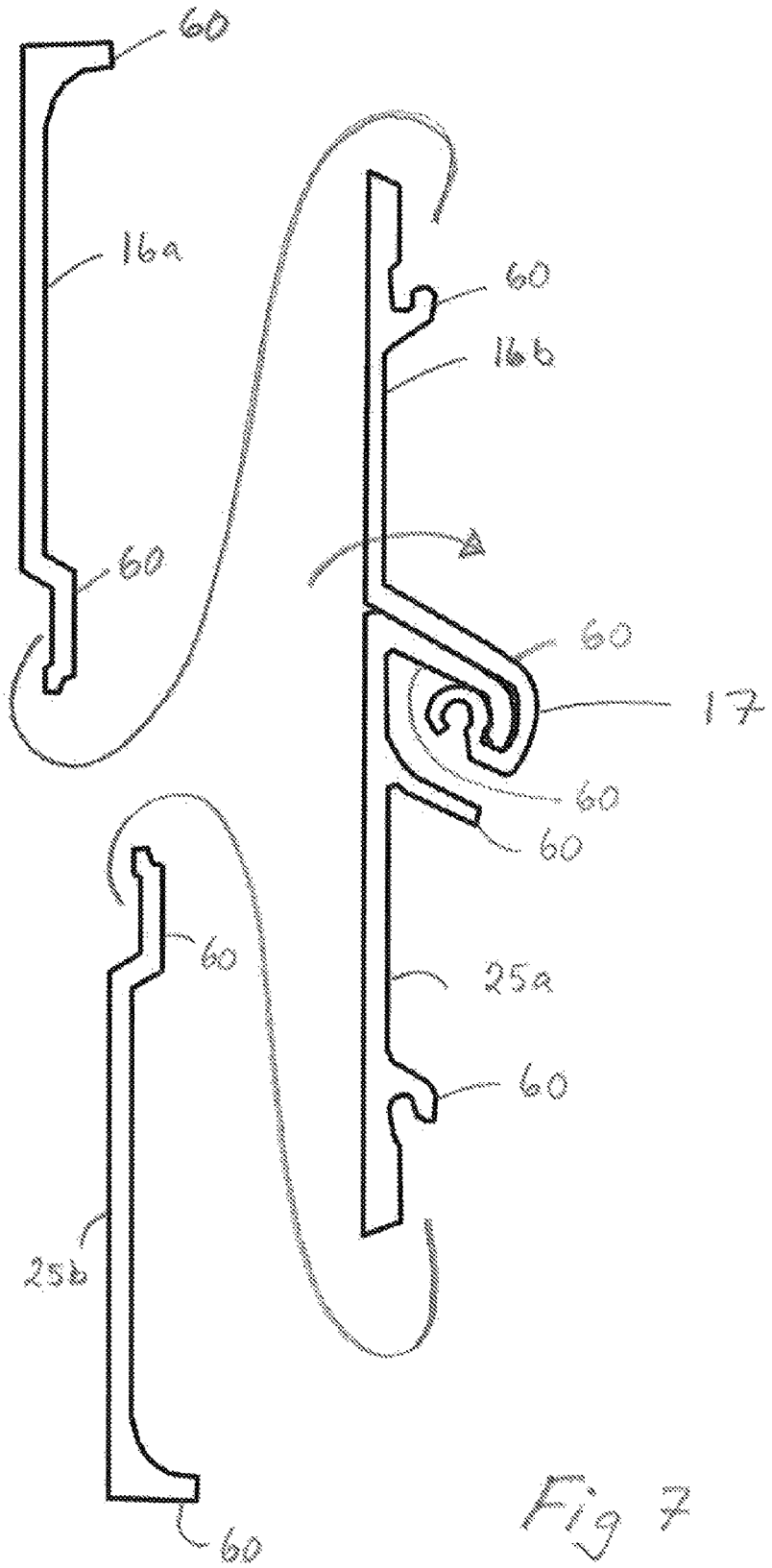
FIG. 7 illustrates a section of a long side of the superstructure, provided with an openable portion.

FIG. 7 shows a section of a long side provided with an openable portion. The design of the plates according to this embodiment is adapted for allowing that the plates may be produced, for example, by extrusion of aluminum or other materials suitable for extrusion. The openable portion 16 is made from two parts 16*a* and 16*b* that are coupled securely together. The lower part of the side (the non-openable portion 25) is made from two parts 25*a* and 25*b* which are coupled securely to each other. An advantage of extruding the parts is that it is possible to obtain a varying thickness and shape over the cross section. As will be seen from FIG. 7, various parts which have the function of providing fixed or rotatable coupling also constitute stiffening folds 60. The openable portion 16 is pivotable in relation to the non-openable portion 25 via hinge joint 17. A corresponding design may also be used for a short side, where the hinge joint 17 then becomes a vertically upright standing hinge joint 13.

In summary, this document describes a collapsible superstructure 1 for a pallet 15, wherein the superstructure 1 comprises: four corner profiles 10, a first pair of opposite sides 11 of the superstructure 1, a second pair of opposite sides 12*a*, 12*b* of the superstructure 1, wherein at least one of the sides in said first pair of opposite sides 11 or said second pair of opposite sides 12*a*, 12*b* is provided with an openable portion 16 in an opening. Moreover, the openable portion 16 is designed such that displacement, in a horizontal direction H along said side provided with an opening, of a first abutment portion relative to a second abutment portion substantially diagonally opposite the first abutment portion is counteracted, and such that displacement, in the horizontal direction H along said side provided with an opening, of a third abutment portion relative to a fourth abutment portion substantially diagonally opposite the third abutment portion is counteracted, whereby a unidirectional angle setting of the two corner profiles 10, connected to the side provided with an opening, along said side provided with the opening, is counteracted.

The invention claimed is:

1. A collapsible superstructure for a pallet, wherein the superstructure comprises:

four corner profiles arranged to, in a raised position of the superstructure, be placed standing upright, in a vertical direction (V), at each corner of said pallet, a first pair of opposite sides of the superstructure, which are structurally separate from and removably fastened to the four corner profiles, which sides are each provided with at least one inner hinge joint, standing upright in the vertical direction, and which sides are each connected to two corner profiles, a second pair, separate from said first pair, of opposite sides of the superstructure, which are structurally separate from and removably fastened to the four corner profiles and which sides are each connected to two corner profiles, wherein the corner profiles and the sides are produced from sheet metal;

wherein, at each one of the corner profiles, at least one of the sides connected to the respective corner profile is connected via upright standing hinge joints for permitting collapse of the superstructure, wherein at least one of the sides in said first pair of opposite sides or in said second pair of opposite sides is provided with an openable portion in an opening, wherein the openable portion is designed such that displacement, in a horizontal direction (H) along said side provided with an opening, of a first abutment portion (A) relative to a second abutment portion (B), substantially diagonally opposite the first abutment portion, is counteracted, and such that displacement, in the horizontal direction along said side provided with an opening, of a third abutment portion (C) relative to a fourth abutment portion (D), substantially diagonally opposite the third abutment portion, is counteracted, wherein the first abutment portion and the third abutment portion are arranged to abut directly or indirectly on one of the corner profiles connected to the side provided with an opening, wherein the second abutment portion and the fourth abutment portion are arranged to abut directly or indirectly on the other of the corner profiles connected to the side provided with an opening, whereby a unidirectional angle setting of the two corner profiles, connected to the side provided with an opening, along said side provided with the opening, is counteracted, wherein the openable portion is composed of one or more sheet metal plates which are folded to form stiffening folds that extend substantially in the horizontal direction along said side provided with an opening, and wherein the stiffening folds in the horizontal direction extend across the whole of the openable portion.

2. The collapsible superstructure for a pallet according to claim 1, wherein the openable portion has a first stiffening portion and a second stiffening portion which are each arranged to extend substantially in the horizontal direction along said side provided with an opening, and which are located at a distance from each other in the vertical direction, wherein the first stiffening portion comprises the first abutment portion and the fourth abutment portion, and wherein the second stiffening portion comprises the second abutment portion and the third abutment portion.

3. The collapsible superstructure for a pallet according to claim 2, wherein the first stiffening portion and the second stiffening portion are connected to each other such that displacement of the first stiffening portion relative to the second stiffening portion, in the horizontal direction along said side provided with an opening, is counteracted.

4. The collapsible superstructure for a pallet according to claim 2, wherein the openable portion is provided with a first side-edge portion, which connects the first abutment portion to the third abutment portion, and is provided with a second side-edge portion, which connects the second abutment portion to the fourth abutment portion.

5. The collapsible superstructure for a pallet according to claim 1, wherein the openable portion is provided with a central opening.

6. The collapsible superstructure for a pallet according to claim 1, wherein the corner profiles connected to the side provided with an opening each comprise an abutment surface which at least partially extends in the vertical direction and which at least partially extends in a transverse direction (T) which is perpendicular to the side provided with an opening, and wherein the respective abutment portions of the openable portion are arranged to abut on the respective abutment surface of the corner profiles and are arranged to transfer pressure forces (F).

7. The collapsible superstructure for a pallet according to claim 1, wherein a non-openable portion of the side provided with an opening comprises, on both sides of the openable portion, an abutment surface which at least partially extends in the vertical direction and which at least partially extends in a transverse direction (T) which is perpendicular to the side provided with an opening, and wherein the respective abutment portions of the openable portion are arranged to abut on the respective abutment surface of the non-openable portion and are arranged to transfer pressure forces (F).

8. The collapsible superstructure for a pallet according to claim 1, wherein each one of the sides in the first pair of opposite sides is connected to two corner profiles via upright standing outer hinge joints for permitting collapse of the superstructure.

9. The collapsible superstructure for a pallet according to claim 1, wherein at least one of the sides in at least said second pair of opposite sides is provided with said openable portion in an opening.

10. The collapsible superstructure for a pallet according to claim 2, wherein the openable portion is provided with a central opening.

11. The collapsible superstructure for a pallet according to claim 2, wherein the corner profiles connected to the side provided with an opening each comprise an abutment surface which at least partially extends in the vertical direction and which at least partially extends in a transverse direction (T) which is perpendicular to the side provided with an opening, and wherein the respective abutment portions of the openable portion are arranged to abut on the respective abutment surface of the corner profiles and are arranged to transfer pressure forces (F).

12. The collapsible superstructure for a pallet according to claim 2, wherein a non-openable portion of the side provided with an opening comprises, on both sides of the openable portion, an abutment surface which at least partially extends in the vertical direction and which at least partially extends in a transverse direction (T) which is perpendicular to the side provided with an opening, and wherein the respective abutment portions of the openable portion are arranged to abut on the respective abutment surface of the non-openable portion and are arranged to transfer pressure forces (F).

13. The collapsible superstructure for a pallet according to claim 2, wherein each one of the sides in the first pair of opposite sides is connected to two corner profiles via upright standing outer hinge joints for permitting collapse of the superstructure.

14. The collapsible superstructure for a pallet according to claim 2, wherein at least one of the sides in at least said second pair of opposite sides is provided with said openable portion in an opening.

15. The collapsible superstructure for a pallet according to claim 1, wherein the openable portion defining an outer surface and the stiffening folds comprising portions of one or more plates folded to extend in a direction transversely to the outer surface of the openable portion.

16. The collapsible superstructure for a pallet according to claim 1, wherein the stiffening folds of the one or more plates overlapping each other.

* * * * *